United States Patent [19]

Okura et al.

[11] 4,385,375

[45] May 24, 1983

[54] MOVING COIL TYPE PHONO CARTRIDGE

[75] Inventors: Keniti Okura; Shinji Yasuda, both of Tokorozawa, Japan

[73] Assignee: Pioneer Electronic Corporation, Tokyo, Japan

[21] Appl. No.: 115,315

[22] Filed: Jan. 25, 1980

[30] Foreign Application Priority Data

| | | | |
|---|---|---|---|
| Jan. 31, 1979 | [JP] | Japan | 54-9064 |
| Jan. 31, 1979 | [JP] | Japan | 54-9066 |
| Jan. 31, 1979 | [JP] | Japan | 54-10643 |
| Mar. 13, 1979 | [JP] | Japan | 54-28205 |

[51] Int. Cl.[3] ..... G11B 3/30

[52] U.S. Cl. ..... 369/139; 369/147; 369/172

[58] Field of Search ..... 369/136, 138, 139, 146, 369/147, 170, 171, 172

[56] References Cited

U.S. PATENT DOCUMENTS

| | | | |
|---|---|---|---|
| 3,991,284 | 11/1976 | Braun | 369/139 |
| 4,233,476 | 11/1980 | Ikeda | 369/136 |
| 4,237,349 | 12/1980 | Hansen et al. | 369/147 |
| 4,272,652 | 6/1981 | Ogikubo | 369/139 |
| 4,327,433 | 4/1982 | Okura et al. | 369/147 X |

*Primary Examiner*—Bernard Konick
*Assistant Examiner*—Donald McElheny, Jr.
*Attorney, Agent, or Firm*—Sughrue, Mion, Zinn, Macpeak and Seas

[57] ABSTRACT

An MC type phono cartridge which is simple in construction and easy to assemble and in which the stylus tip may be easily interchanged. The cartridge includes a pair of magnet units and an associated vibration unit. Included in the vibration unit is a cantilever with a stylus tip fixed to one end thereof with a disc-like member fixed to the other end of the cantilever. A string is attached at one end to the cantilever and at the other end to a string member holder which is in turn attached to the supporting member. A damper is disposed between a disc-like member and the supporting member. A pair of induction coils are disposed on the disc-like member. Each of the two magnet units includes a pair of adjacent magnets disposed with like magnetic poles confronting each other with the confronting portions of the magnets spaced from the induction coil at a preset gap. The vibration unit is detachable from the magnet unit for ease of stylus tip interchange.

18 Claims, 20 Drawing Figures

MOVING COIL TYPE PHONO CARTRIDGE

BACKGROUND OF THE INVENTION

The present invention relates to a moving coil type cartridge hereinafter referred to as an "MC type". More particularly, it relates to an electrical signal generating structure for an MC type phono cartridge.

In an MC type phono cartridge, a pair of moving coils connected to a cantilever are disposed in a predetermined magnetic field defined by a magnet and a pair of pole pieces so that a voltage induced by the movement of the cantilever can be picked up as an electric signal.

The output voltage of a phono cartridge of the above-described MC type is low in comparison with other magnetic phono cartridges such as a moving magnet type cartridge. Since in an MC cartridge the moving coils are directly connected to the cantilever, it is very difficult to interchange styli or needles. Moreover, the assembly of such a cartridge requires much skill and manual dexterity. The MC cartridge assembly is thus time-consuming making it unsuitable for mass production and accordingly, expensive. Although the MC cartridge possesses such disadvantages, it is widely used especially in top class equipment because of its extreme high-fidelity.

Various different MC cartridges have been proposed. In most of these, paired pole pieces are employed to form the magnetic fields as described above. For this reason, the total weight of the cartridge is disadvantageously large. In addition, most MC cartridges require moving coils which are precisely machined so as to enhance the voltage induction efficiency. Such moving coils are difficult to produce.

It is thus an object of the present invention to provide an MC type photo cartridge whose construction is simple, whose voltage induction efficiency is high, in which stylus interchange is easy, and which is easy to assembly.

SUMMARY OF THE INVENTION

These, as well as other objects of the invention, are met by an MC type phono cartridge including a pair of magnet units and an associated vibration unit. The vibration unit includes a cantilever and stylus tip provided at a free end of the cantilever, a disc-like member fixed at the other end of the cantilever, a string member and string member holder with the string member being attached at one end thereof to the other end of the cantilever with the other end of the string member connected to the string member holder, a supporting member for supporting the string member holder, a damper disposed between the disc-like member and the supporting member, and a pair of induction coil means disposed on the disc-like member. The magnet units each include a pair of adjacent magnets disposed with like magnetic poles confronting each other and with the confronting portions of the magnet spaced from the induction coil means at a predetermined gap interval. The vibration unit is made detachable from the magnet unit so that the stylus tip can be easily interchanged.

In one embodiment, the adjacent magnets are in intimate contact with one another with an interface formed therebetween. In this case, the center of the induction coil means is in a surface including the interface. Preferably, the induction coil means includes at least induction coil with the direction of magnetization of each of the magnets substantially parallel to an axial direction of the induction coil. Otherwise, the induction coil may include a single induction coil with the direction of magnetization of each magnet substantially parallel to an axial direction of the induction coil. The disc-like member may include first and second magnetic discs each provided with a pair of projections extending therefrom which form a right angle with respect to the centers thereof. The projections confront each other and are spaced apart by a predetermined distance. At least one of the projections is provided with an induction coil and each magnet unit includes two magnets and a yoke member interposed therebetween with the direction of magnetization of each magnet being substantially parallel to the axial direction of the cantilever. In this embodiment, a spacer disc may be interposed between the first and second magnetic discs. The disc-like member may be made of non-magnetic material and be provided with a pair of cut-away portions. The induction coil means may then include an independent coil wound on a magnetic bobbin while each of the magnet units includes two magnets and a yoke member interposed therebetween. The direction of magnetization of each of the magnets is substantially parallel to the axial direction of the cantilever. The magnetic bobbin may be H-shaped in cross-section.

BRIEF DESCRIPTION OF THE DRAWINGS

FIGS. 4 through 8B illustrate a third embodiment of the invention wherein FIG. 4 is an exploded view of a vibration unit, FIG. 5 is an exploded view of a magnet unit, FIG. 6 is a side-cross sectional view showing the assembled unit, FIG. 7 is a front-cross sectional view showing the assembled unit, and FIGS. 8A and 8B are diagrams illustrating movement of the cantilever member of this embodiment;

FIGS. 10 through 13B show a fourth embodiment of the invention wherein FIG. 10 is an exploded view of the vibration unit, FIG. 11 shows the assembled form of the vibration unit, FIGS. 12B and 13B illustrate the induced voltage in the coil of the cartridge for the cases of FIGS. 12A and 13A, respectively.

DESCRIPTION OF THE PREFERRED EMBODIMENT

Figure 1A:
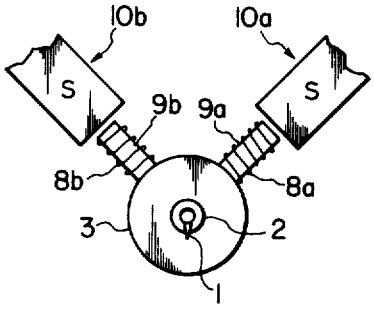
FIG. 1A is a frontal fragmentary view showing a primary portion of an MC type phono cartridge embodying the invention.
Figure 1B:
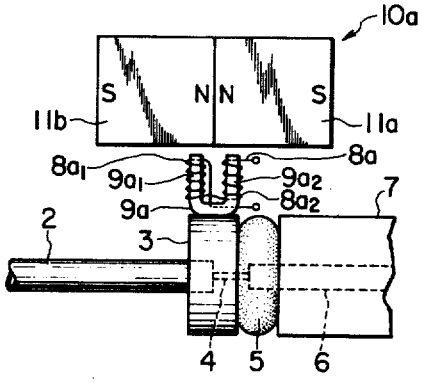
FIG. 1B is a side view of the cartridge shown in FIG. 1A.

The present invention will hereinafter be described with reference to the accompanied drawings. FIG. 1A is a frontal fragmentary view showing a primary portion of an MC type phono cartridge embodying the invention. FIG. 1B is a side view of one channel thereof. Referring to these figures, a cantilever 2 has a stylus tip 1 at its free end. A string or wire 4 attached at the rear end at which a disc-like member 3 made, for example, of magnetically permeable material is provided. The string 4 is provided for properly maintaining the center of vibration of the cartridge. Reference numeral 5 designates a damper for damping the vibration of the cantilever 1. The cantilever 2 is supported by a string holder 6 which retains the other end of the string 4. The string holder 6 imparts a suitable tension to the string 4 and is supported by a supporting member 7.

Mounted on the disc 3 at the rear end of the cantilever 2, first and second coils 8*a* and 8*b* form a substantially right angle to each other with respect to the center axis of the cantilever 2. The paired coils 8*a* and 8*b* are each wound on substantially U-shaped magnetic cores 9*a* and 9*b* which are made, for example, of permalloy. Each of cores 9*a* and 9*b* is fixed to the disc 3 so as to form a substantially right angle to the center axis of the cantilever. Coils $8a_1$ and $8a_2$, which are connected in series, are wound on a pair of leg portions $9a_1$ and $9a_2$ each extending from the magnetic core 9*a* thereby forming the coil 8*a*. If desired, it is possible to dispense with the magnetic cores 9*a* and 9*b* for the coils 8*a* and 8*b*.

Reference numerals 10*a* and 10*b* designate a pair of magnets each of which is composed of two magnets 11*a* and 11*b* confronting each other with the polarities of the two magnets 11*a* and 11*b* being such as to urge the magnets away from each other. The two magnets may be in contact with each other. The repulsive portions of the magnets 10*a* and 10*b* face the respective first and second coils 8*a* and 8*b* at set intervals. It is desirable that the magnetic lines of force of the paired magnets 11*a* and 11*b* in the first or second magnet pair 10*a*, 10*b* be substantially parallel to the center axis of the centilever 2. It is not always required that the same polarities of the magnets 11*a* and 11*b* be in contact with each other. A small magnetic gap may be provided therebetween with like polarities facing each other. Due to the fact that the like polarities, for example, N-poles of the magnets 11*a* and 11*b*, substantially face each other as shown in FIG. 1B, the magnetic flux is concentrated substantially perpendicular to the magnetic lines of force of the magnets 11*a* and 11*b*.

The operation of the thus constructed cartridge will be described. Reference will be made only to one channel, specifically, the combination of the first coil 8*a* and the magnet pair 10*a*. When the cantilever 2 is not vibrating, the magnetic gap at the end of the leg portions $9a_1$ and $9a_2$ of the core 9*a*, on both of which the coil 8*a* is continuously wound, are equal so that the magnetic fluxes passing through the coils $8a_1$ and $8a_2$ are also equal. Therefore, the induced electric currrents flowing through the coils $8a_1$ and $8a_2$ are offset. When the cantilever 2 moves upward in FIG. 1B, the magnetic gap between the leg portion $9a_1$ of the core 9*a* and the confronting polar portion 11*b* is smaller than that between the leg portion $9a_2$ and the confronting pole portion 11*a*. In this case, the magnetic flux passing through the coil $8a_1$ is greater than that passing through the coil $8a_2$ and an electric current will be induced to flow in a predetermined direction corresponding to the difference in the magnetic fluxes. On the other hand, when the cantilever 2 moves downwarly in FIG. 2B, the magnetic gap between the leg portion $9a_2$ and the confronting pole portion is smaller than that between the leg portion $9a_1$ and its confronting pole portion. Accordingly, the magnetic flux passing through the coil $8a_2$ is greater than that through the coil $8a_1$. In response to the difference therebetween, an electric current will flow in the opposite direction to the first-mentioned direction.

Figure 2A:
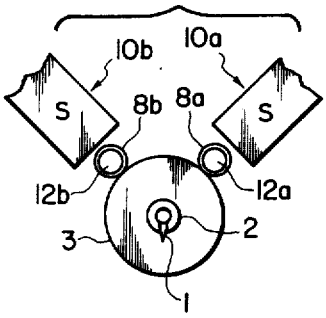
FIG. 2A is a frontal fragmentary view showing a primary portion of a second embodiment of an MC type phono cartridge embodying the invention.
Figure 2B:
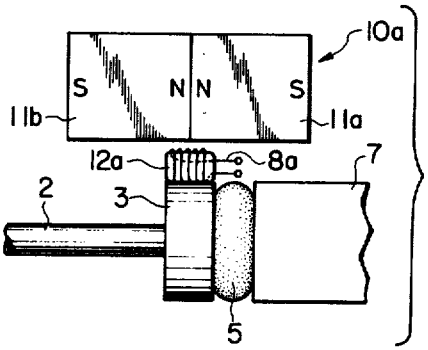
FIG. 2B is a side view of the cartridge shown in FIG. 2A.

FIG. 2A is a frontal fragmentary view of a second embodiment of an MC phono cartridge according to the present invention. Reference will also be made to only one channel in FIG. 2B. In these figures, like components will be denoted by the same reference characters. This embodiment is substantially the same as the first embodiment except for the following point. In this embodiment, first and second coils 8*a* and 8*b* are, respectively, wound on a pair of cylindrical cores 12*a* and 12*b* which are mounted on a disc-like member 3 positioned perpendicular to the center axis of the cantilever 2 and which is made of a magnetic material such as permalloy. The cores 12*a* and 12*b* are mounted so that their center axes are ach parallel to the center axis of the cantilever 2. In the same embodiment as in the first embodiment, the cores 12*a* and 12*b* may be dispensed with, or in this parallel arrangement it is possible to insert into each coil a non-magnetic core, for example, of plastics instead of the magnetic core.

The operation of the thus constructed cartridge will be described with reference only to a single channel, specifically, the combination of the first coil 8*a* and the magnet pair 10*a*. When the cantilever is not vibrating, magnetic flux from the confronting pole portion will pass through the first coil 8*a* perpendicular to the center axis thereof into the disc-like member 3 of magnetic material since the magnetic lines of force of the magnets 11*a* and 11*b* are parallel to the center axis of the core 12*a*. Therefore, no electric current will be generated in the first coil 8*a*. When the cantilever 2 moves upwardly in FIG. 2B, the disc-like member 3 rotates clockwise about the vibration supporting center and therefore a magnetic gap between the left end of the magnetic core 12*a* and the confronting pole portion of the magnets 11*a* and 11*b* is small in comparison with the magnetic gap between the right end thereof and the confronting pole portion of the magnets 11*a* and 11*b*, allowing the magnetic flux from the confronting pole portion to pass from the left to right and to enter the disc-like member 3. Therefore, an electric current will flow in the first coil in a direction corresponding to this magnetic flux. On the other hand, when the cantilever 2 moves downwardly, the magnetic cap between the right end of the core 12*a* and the confronting pole portion is smaller than that between the left end of the core 12*a* and the confronting pole portion and accordingly, the magnetic flux from the pole portion passes through the magnetic core 12*a* from the right to left ends thereof in response to the rotation of the magnetic core 12*a* and enters the disc-like member 3. Accordingly, an induced electric current flows in the first coil 8*a* in response to this magnetic flux in the direction opposite to the first-mentioned direction. As mentioned above, according to the present invention, minute rotation of the coils causes an electric current to flow in response thereto. During rotation of the first coil 8*a*, the gaps defined between both ends of the second coil 8*b* and the magnet pair 10*b* are constant, and so independent left and right channels may be provided for stereophonic signals.

Figure 3:
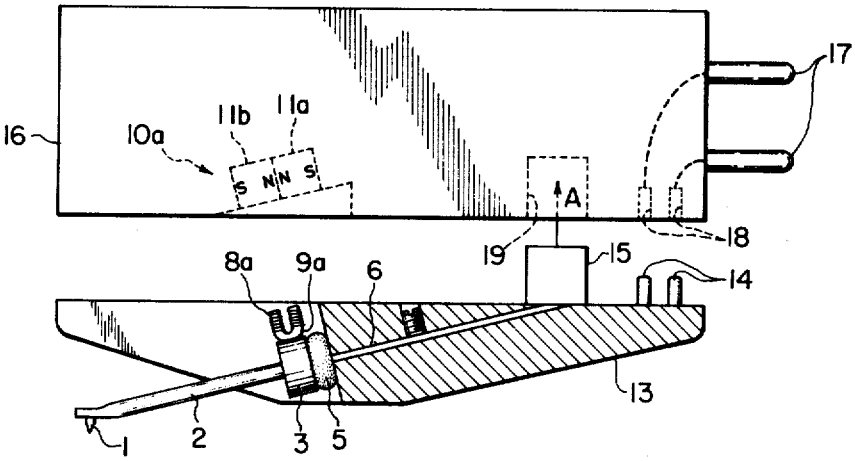
FIG. 3 is a side view, partially in cross section, showing a cartridge body of the invention just prior to assembly.

FIG. 3 is a side view, partially in cross-section, showing a cartridge body just prior to assembly according to the present invention in which like members are designated by the same reference characters as in FIG. 1. In FIG. 3, a stylus unit including a stylus tip 1, a cantilever 2 and a disc-like member 3 and supported in a first case 13 by a damper 5. Four lead lines (not shown) are coupled to two coils 8*a* and 8*b* mounted on the disc-like member 3 and are connected to four terminal pins 14. A positioning projection 15 extends from the upper surface of the first case 13. Reference numeral 16 designates a second case having four terminal pins 17 for external connection. The first and second magnetic pairs 10*a* and 10*b* are received in the second case 16. In the second case 16 are formed four terminal receiving slots 18 electrically contacting the four terminal pins 14 of the first case 13 and are electrically connected to the external connection terminals 17 as shown by dotted lines.

Upon assembly, a projection 15 of the first case 13 is inserted into a recess 19 of the second case 16 as indicated by arrow A and fixed thereto by fastening means (not shown) to thereby couple the first and second cases 13 and 16 and at the same time bringing the first and second coils 8*a* and 8*b* into confrontation with the opposing pole portions of the first and second magnet pairs 10*a* and 10*b*, respectively. At this point, the cartridge body assembly is completed. This assemblying provides ready interchangeability due to its structure for the cartridge.

As is clear from the above, according to the MC type cartridge of the present invention, since pole pieces which form a portion of the magnetic circuitry may be dispensed with, the weight of the cartridge body is remarkably reduced and, since the configuration or structure is simple and readily assembled, mass-production is possible at low cost. Also, since the stylus unit may be fixed in a suitable position after the stylus unit assembly is completed, a great amount of skill or manual dexterity is not required to assemble the cartridge. Further, it is possible to completely separate the vibration unit and magnet unit from each other. For this reason, the invention renders possible easy stylus interchange which had hitherto been considered impossible for an MC cartridge.

Figure 4:
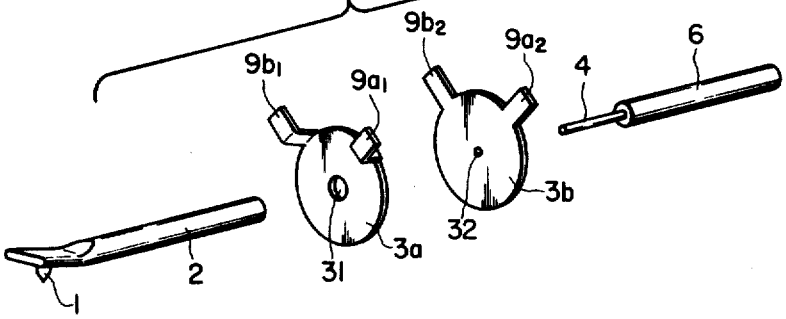

Still another embodiment according to the present invention will be described with reference to FIGS. 4 through 8B. FIG. 4 is an exploded view of a vibration unit which is composed of a cantilever 2 having at its tip end a stylus tip 1, a first magnetic disc-like plate 3*a* having two projections $9a_1$ and $9b_1$ each bent in a single direction as shown and extending to form a right angle with respect to the center of the first disc 3*a*, a second magnetic disc-like plate 3*b* having two projections $9a_2$ and $9b_2$ both forming a right angle with respect to the center of the second disc 3*b*, and a suspension holder 6 having a suspension wire or string 4.

Figure 6:
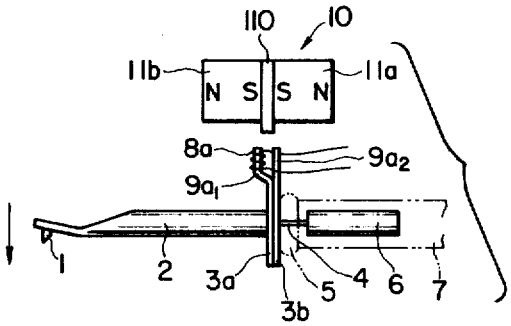

For assembly, the first and second magnetic discs are intimately coupled to each other so that the projections $9a_1$ and $9a_2$, and $9b_1$ and $9b_2$ are spaced from each other. Respective coils 8*a* and 8*b* are wound on the projections $9a_1$ and $9b_1$ of the first magnetic disc 3*a*. The coils 8*a* and 8*b* are used as injection coils for two separate channels. In the central portion of the first magnetic disc 3*a* is provided a hole 31 which is somewhat larger than the outer diameter of the cantilever 2 while in the second magnetic disc 3*b* is provided a hole 32 which is somewhat larger than the outer diameter of the suspension wire 4. The suspension wire 4 is inserted through the hole 32 of the second magnetic disc 3*b* and its end portion is expanded in a suitable manner to prevent the withdrawal of the wire 4. The base end of the cantilever 2 is inserted into the hole 31 of the first magnetic disc 3*a* and fixed thereto. In this manner, the vibration unit is assembled as shown in FIG. 6. In the same manner as in the preceding embodiments, the unit is provided with a rubber damper 5 and secured to the holder 7 so that the cantilever can vibrate while the hole 32 of the second magnetic disc 30 forms a support point thereof.

Figure 5:
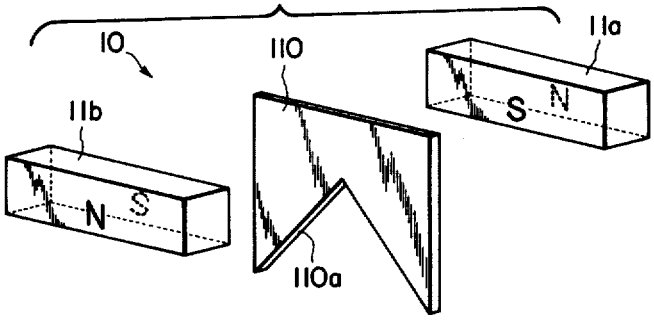

FIG. 5 is an exploded view showing a single magnet unit 10 for this embodiment. Like polarities of magnets 11*a* and 11*b* face each other. Between them is sandwiched a yoke 110 having a cut-away portion 110*a* at a right angle. This magnetizing circuit is arranged above the two paired projections $9a_1$, $9a_2$ and $9b_1$, $9b_2$ of the first and second magnetic discs, so that the magnetizing direction of the magnets 11*a* and 11*b* are each aligned with the direction of the cantilever.

Figure 7:
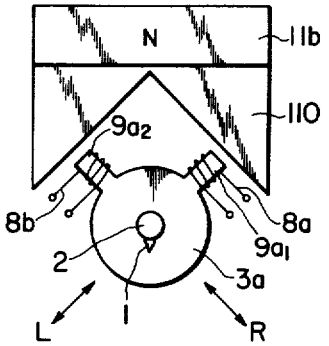
Figure 8A:
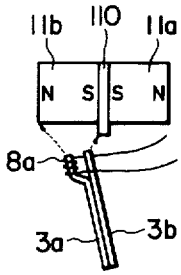
Figure 8B:
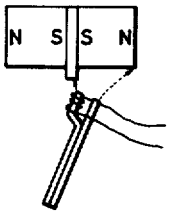

The operation of this embodiment will be described. Referring to FIG. 7, when the cantilever 2 vibrates in a direction indicated by an arrow L, the coil 8*a* vibrates back and forth with respect to the yoke 110 resulting in an induced voltage. In other words, when the cantilever 2 moves downwardly as shown in FIG. 8A, the magnetic flux from the magnet 11*b* passes through the coil 8*a*. When the cantilever 2 moves upwardly as shown in FIG. 8B, the magnetic flux from the other magnet 11*a* passes through the coil 8*a* in the opposite direction. In this case, the cantilever 2 vibrates so that the magnetic flux passing through the coil 8*a* is varied to thereby produce an electrical signal. During the vibration of the cantilever in the direction of the arrow L, the other coil 8*b* moves in such a manner so as not to traverse the magnetic flux. In this case, an electrical signal is not produced by the coil 8*b*.

When the cantilever 2 vibrates in the direction indicated by the arrow R, a voltage is induced in the coil 8*b* but no voltage is induced in the coil 8*a*. Thus, an electrical signal of high fidelity is produced.

Figure 9:
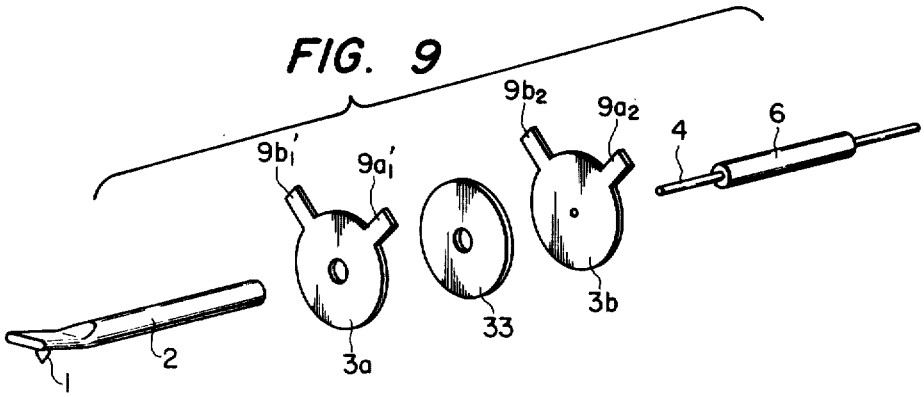
FIG. 9 is an exploded view showing a modification of the embodiment of FIGS. 4 through 8B.

FIG. 9, which is also an exploded view, shows a modification of the last described embodiment. Projections $9a_1'$ and $9b_1'$ of the first magnetic disc 3*a* are not bent. Between the first and second magnetic plates 3*a* and 3*b* is disposed a spacer disc 33 which maintains a gap between the projections $9a_1'$ and $9a_2$ and between the projections $9b_1'$ and $9b_2$.

In each of these embodiments, since moving coils are provided on the projections extending from the magnetic discs without intervening members, stylus interchange is easy.

Figure 10:
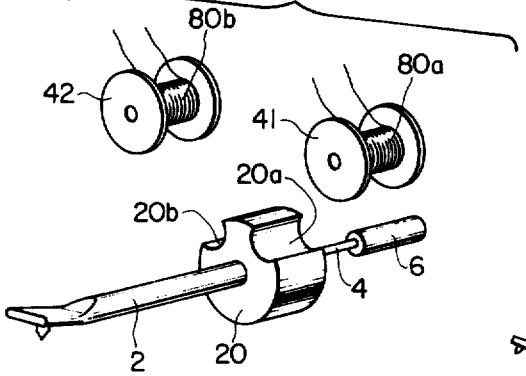

A still further embodiment will be described with reference to FIGS. 10 to 13B. FIG. 10 is an exploded view of the vibration unit in which like parts with respect to the previously described embodiments are designated by the same numbers. In this embodiment, a disc-like member 20, made of non-magnetic material, is provided with a pair of cut-away portions 20*a* and 20*b* for receiving bobbins 41 and 42. The attached bobbins 41 and 42 form a right angle with respect to the center axis of the cantilever 2 or its extension. Each of the bobbins is provided with an individual coil 80*a* or 80*b*. The bobbins 41 and 42 are H-shaped in cross-section. For these bobbins, it is possible to automatically and evenly wind coil wires thereon. Due to this advantage, mass-production of such coil having uniform properties is possible. The bobbin may be attached to the disc 20 by suitable means, for example, chemical adhesion.

Figure 11:
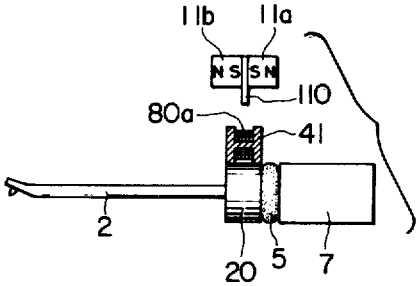

The magnetizing circuit or unit for the coils 80*a* and 80*b* is composed of magnets in which the same polarities thereof face each other and yoke 110 is interposed between the magnets in the same manner as in the previous embodiments. A wedge-shaped cut-away portion 110*a* is provided in the lower portion of the common yoke 110. FIG. 11 shows its assembled form. Also, reference will be made to only one channel. When the cantilever 2 is not moving, the common yoke 110 of the magnetizing unit is positioned directly above the center of the bobbin 41 suitably attached to the holding disc 20.

Figure 12A:
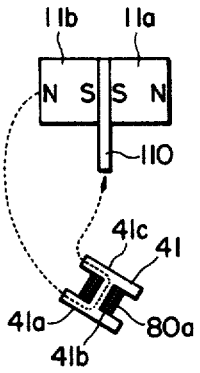
FIGS. 12A and 13A are diagrams illustrating movement of cantilever member.
Figure 13A:
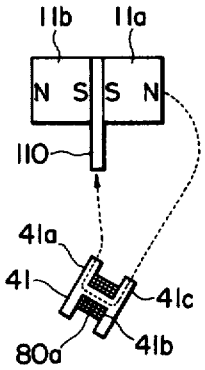
Figure 12B:
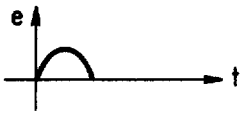
Figure 13B:
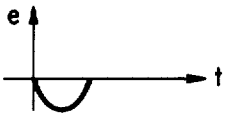

In the above described embodiment, when the cantilever 2 moves downwardly as shown in FIG. 12A, the bobbin 41 tilts and, accordingly, the magnetic flux passes from the magnet unit, that is, the magnetic north pole N of the magnet 11*b* through one flange 41*a*, core 41*b* and the other flange 41*c* of the bobbin 41 to the yoke 110 from which it enters the magnetic south pole S of the magnet 11*b*. Accordingly, an induced voltage e is generated as shown in FIG. 12B. On the other hand, when the cantilever 2, as shown in FIG. 13A, moves downwardly, the magnetic flux passes from the magnet unit, that is, the north pole N of the magnet 11*a* through the other flange 41*c*, the core 41*b* and the flange 41*a* of the bobbin 41 to the yoke 110 to the south pole S of the magnet 11*a*. The induced voltage is shown in FIG. 13B.

In this embodiment, the holding disc 20 may be made of non-magnetic material such as aluminum. It is possible to make the disc 20 integral with the suspension wire which may be made of polyamide resin or the like. It should be noted that presently commercially available coils can be provided perpendicular to the axis of the cantilever.

Figure 14A:
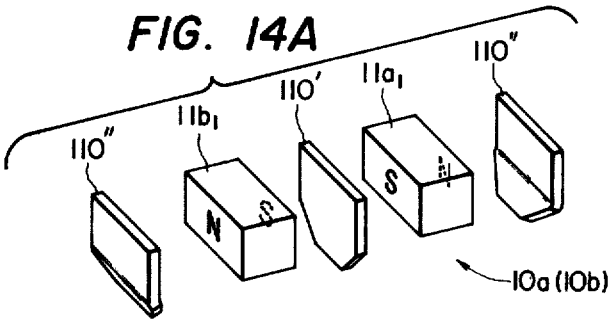
FIG. 14A is an exploded view of each magnet unit and FIG. 14B is a cross section of the assembled magnet unit shown in FIG. 14A.
Figure 14B:
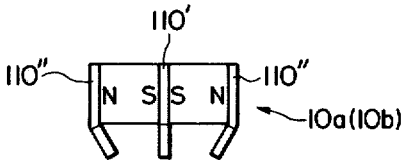

FIGS. 14A and 14B show a modification to the last mentioned embodiment. In this modification, two magnet units each constructed in the previous manner are provided to confront the bobbin coils, for example, shown in FIG. 10. FIG. 14A shows an exploded view of a magnet unit on one channel side and FIG. 14B shows a cross sectional view of the assembled magnet unit 10*a* (or 10*b*). Three yokes 110' and 110" are each made substantially rectangle and cut at lower corners. The yokes 110" at the ends of the magnet unit are bent inwardly at lower portions as shown.

What is claimed is:

1. An MC type phono cartridge comprising: at least one magnet unit; an associated vibration unit including a cantilever, a stylus tip provided at one free end of said cantilever and a disc-like member fixed at the other end of said cantilever; a supporting member for supporting said cantilever to be vibrated; a damper, said damper being disposed between said vibration unit and said supporting member; induction coil means disposed on said disc-like member; said magnet unit including first and second adjacent magnets, each of said first and second adjacent magnets having opposite poles, a longitudinal axis of each of said magnets passing through said opposite poles, said longitudinal axis of said first magnet being aligned with said longitudinal axis of said second magnet, one of said poles of said first magnet confronting a corresponding like pole of said second magnet, said induction coil means being spaced from said aligned longitudinal axes of said confronting like poles by predetermined gap intervals.

2. The MC type phono cartridge as defined in claim 1, wherein said induction coil means includes at least one induction coil and wherein the direction of magnetization of each magnet is substantially perpendicular to an axial direction of said induction coil.

3. The MC type phono cartridge as defined in claim 1 wherein said magnet unit generates a magnetic flux concentrated on a center plane of said magnet unit which is equidistant from said confronting like poles, said induction coil means being positioned on said center plane.

4. The MC type phono cartridge as defined in claim 1, wherein a center axis of said induction coil means is in a plane which is equidistant from said confronting like poles.

5. The MC type phono cartridge as defined in claim 4, wherrein said confronting like poles of said adjacent magnets are in contact with each other.

6. The MC type phono cartridge as defined in claim 4, further comprising a yoke sandwiched between said confronting like poles of said adjacent magnets.

7. The MC type phono cartridge as defined in claim 1, wherein said induction coil means includes a single induction coil and the direction of magnetization of each magnet is substantially parallel to an axial direction of said induction coil.

8. The MC type phono cartridge as defined in claim 7, wherein said induction coil has a hollow space therein without a core member.

9. The MC type phono cartridge as defined in claim 7, wherein said induction coil has a non-magnetic core of plastics therein.

10. The MC type phono cartridge as defined in claim 1, wherein two of said magnet units are provided.

11. The MC type phono cartridge as defined in claim 1, wherein only a single one of said at least one magnet unit is provided.

12. The MC type phono cartridge as defined in claim 11, wherein said disc-like member includes first and second magnetic discs each provided with a pair of projections extending therefrom which form a right angle with respect to the center thereof, the projections confronting each other and being spaced apart, at least one of said projections being provided with an induction coil, and said single magnet unit includes a yoke member interposed between said first and second adjacent magnets, said yoke member having a cut-away portion at a substantially right angle, the direction of magnetization of each magnet being substantially parallel to the axial direction of the cantilever.

13. The MC type phono cartridge as defined in claim 12, further comprising a spacer disc interposed between said first and second magnetic discs.

14. The MC type phono cartridge as defined in any one of claims 1, 2, 4 or 7–13, further comprising a case supporting each of said at least one magnet unit, said supporting member being attachable to and detachable from said case.

15. The MC type phono cartridge as defined in claims 10 or 11, wherein said disc-like member is made of non-magnetic material and is provided with a pair of cut-away portions, the induction coil means includes at least one independent coil wound on a magnetic bobbin, and each magnet unit includes two magnets and at least one yoke member, the direction of magnetization of each magnet being substantially parallel to the axial direction of the cantilever.

16. The MC type phono cartridge as defined in claim 15, wherein said magnetic bobbin is H-shaped in cross section.

17. The MC type phono cartridge as defined in claim 15, wherein each of said magnet units further includes two yoke members disposed at both ends to enhance the magnetic efficiency.

18. The MC type phono cartridge as defined in claim 15, further comprising a case supporting each of said at least one magnet unit, said supporting member being attachable to and detachable from said case.

* * * * *